US011731812B2

(12) United States Patent
Hsu

(10) Patent No.: US 11,731,812 B2
(45) Date of Patent: Aug. 22, 2023

(54) EASY-TEAR-OPEN AND TAMPER-EVIDENT CONTAINER

(71) Applicant: Meng-Yun Hsu, Taipei (TW)

(72) Inventor: Meng-Yun Hsu, Taipei (TW)

( * ) Notice: Subject to any disclaimer, the term of this patent is extended or adjusted under 35 U.S.C. 154(b) by 0 days.

(21) Appl. No.: 17/934,045

(22) Filed: Sep. 21, 2022

(65) Prior Publication Data

US 2023/0219721 A1 Jul. 13, 2023

(30) Foreign Application Priority Data

Jan. 7, 2022 (TW) ..... 111200217

(51) Int. Cl.
*B65D 55/02* (2006.01)
*B65D 43/02* (2006.01)

(52) U.S. Cl.
CPC ..... *B65D 43/0287* (2013.01); *B65D 2401/30* (2020.05)

(58) Field of Classification Search
CPC .. B65D 2543/00296; B65D 2543/0062; B65D 2543/00731; B65D 2401/10; B65D 2401/15; B65D 2401/50; B65D 2401/60; B65D 11/10; B65D 11/105
USPC ..... 220/4.26, 4.21, 270, 266, 276, 780, 212, 220/791, 377
See application file for complete search history.

(56) References Cited

U.S. PATENT DOCUMENTS 4,330,700 A * 5/1982 Jagieniak ..... B23K 10/006 219/121.36
7,118,003 B2 * 10/2006 Sellari ..... B65D 43/021 220/780
2016/0023815 A1 * 1/2016 Siskindovich ..... B65D 1/34 220/270

* cited by examiner

*Primary Examiner* — King M Chu
(74) *Attorney, Agent, or Firm* — Guice Patents PLLC

(57) ABSTRACT

An easy-tear-open and tamper-evident container including: a container body having a first convex loop on a periphery of an opening thereof; a lid having a second convex loop for engaging with the first convex loop, where a loop of tear line is provided on a topmost surface of the second convex loop, and the loop of tear line is divided into a section of breakable line and a section of broken line; and a spacer part being disposed below a local area of the topmost surface of the second convex loop that bears the section of broken line to make the local area bent up to form an force application part.

7 Claims, 8 Drawing Sheets

EASY-TEAR-OPEN AND TAMPER-EVIDENT CONTAINER

FIELD OF THE INVENTION

This invention is related to food delivery containers, especially to tamper-evident containers.

DESCRIPTION OF THE RELATED ART

In modern industrial and commercial societies, people's diet habits have changed a lot, the most obvious of which is the substantial increase in the eating-out population. For the eating-out population, lunch container or fast food is the most convenient and economical way of serving a meal. In addition, due to the current global epidemic, not only the eating-out population, but many families are gradually relying on food delivery services to reduce going out.

However, recently there have been occasional cases of delivery persons stealing or tampering with meals, which not only cause panic to consumers, but also affect the reputation of delivery service platforms and meal providers.

Therefore, there is an urgent need in the field for a novel tamper-evident container.

SUMMARY OF THE INVENTION

One objective of the invention is to disclose an easy-tear-open and tamper-evident container, which, by installing a loop of tear line around the periphery of the lid of the container, can leave evidence at any part of the periphery of the container when that part of the periphery is opened by an illegitimate person.

Another objective of the invention is to disclose an easy-tear-open and tamper-evident container, which has an up-bent force application part formed at a local area of a convex loop of the lid for the legitimate user to easily apply a force thereon to break the loop of tear line to open the lid.

Still another objective of the invention is to disclose an easy-tear-open and tamper-evident container, which can enable the user to place the removed central part of the lid back onto the convex loop of the container to preserve warmth or prevent pollution.

To attain the aforementioned objectives, an easy-tear-open and tamper-evident container is proposed, which includes:

a container body having a first convex loop on a periphery of an opening thereof;

a lid having a second convex loop for engaging with the first convex loop, where a loop of tear line is provided on a topmost surface of the second convex loop, and the loop of tear line is divided into a section of breakable line and a section of broken line, the section of breakable line having a length larger than that of the broken line; and a spacer part being disposed below a local area of the topmost surface of the second convex loop that bears the section of broken line, and the spacer part being attached with the lid or the container body to make the local area bent up to form an force application part;

where, when in a normal opening operation, the force application part is used for a user to apply a force thereon to break the section of breakable line to remove a central area of the lid; and when an illegitimate user applies a lifting force on any local area of the second convex loop of the lid that corresponds to the section of breakable line to make the local area moving upward with a displacement exceeding a threshold, a corresponding local area of the section of breakable line will be broken to show that the tamper-evident container has been tampered with.

In one embodiment, the lid has a force application structure formed inside an area surrounded by the second convex loop, and the force application structure has multiple concave or convex structures for a legitimate user to pull up or press down to break the section of breakable line.

In one embodiment, the lid is made of plastic.

In one embodiment, the container body is made of plastic.

In one embodiment, the container body is transparent.

In one embodiment, the container body has a shape of circle or polygon.

In one embodiment, the lid has a tableware accommodating structure formed inside the area surrounded by the second convex loop for accommodating at least one piece of tableware.

For possible embodiments, the at least one piece of tableware can be any combination of chopsticks, spoons, knives and forks.

To make it easier for our examiner to understand the objective of the invention, its structure, innovative features, and performance, we use preferred embodiments together with the accompanying drawings for the detailed description of the invention.

DETAILED DESCRIPTION OF THE INVENTION

Figure 1:
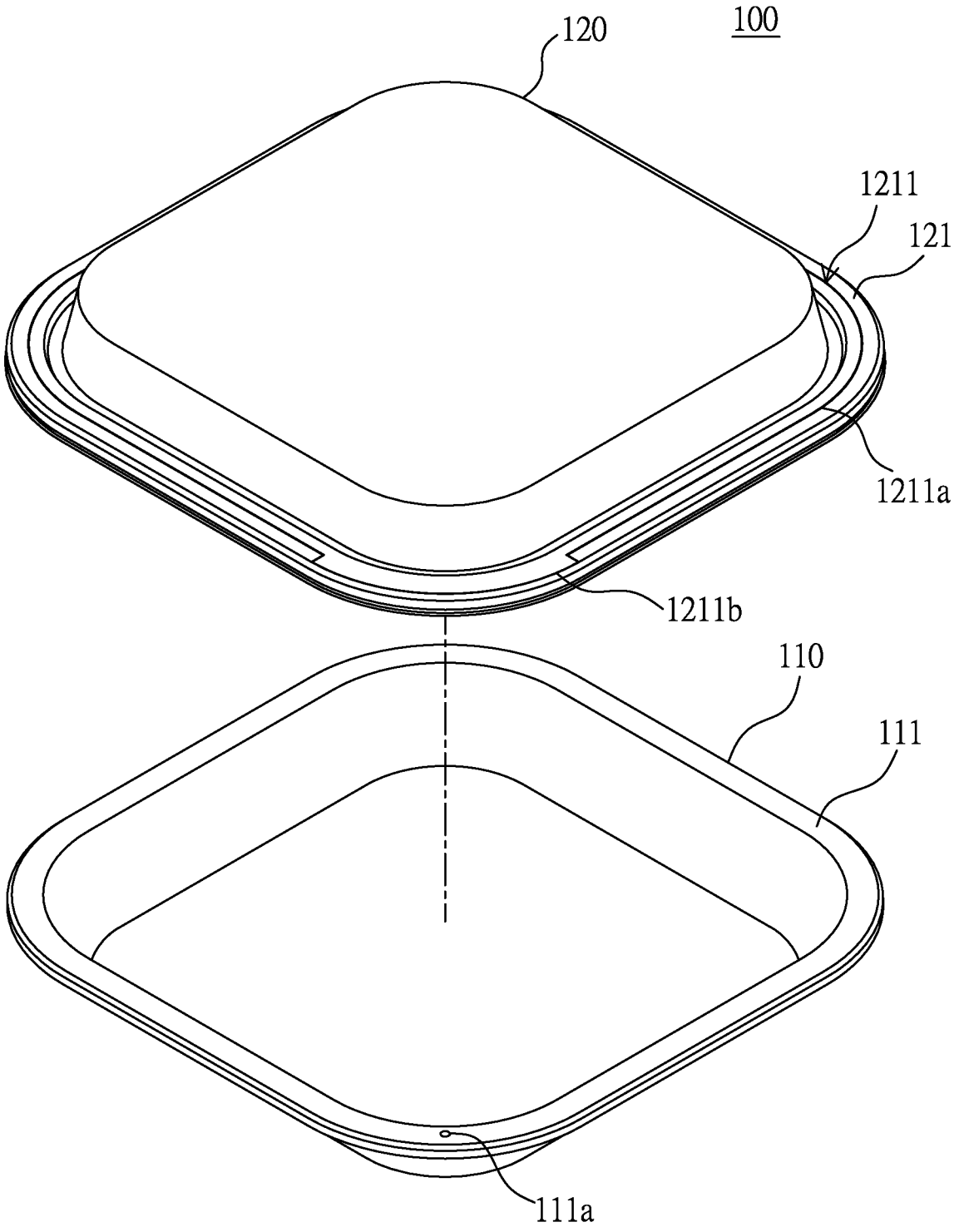
FIG. 1 illustrates an exploded diagram of one embodiment of the easy-tear-open and tamper-evident container of the present invention.
Figure 2:
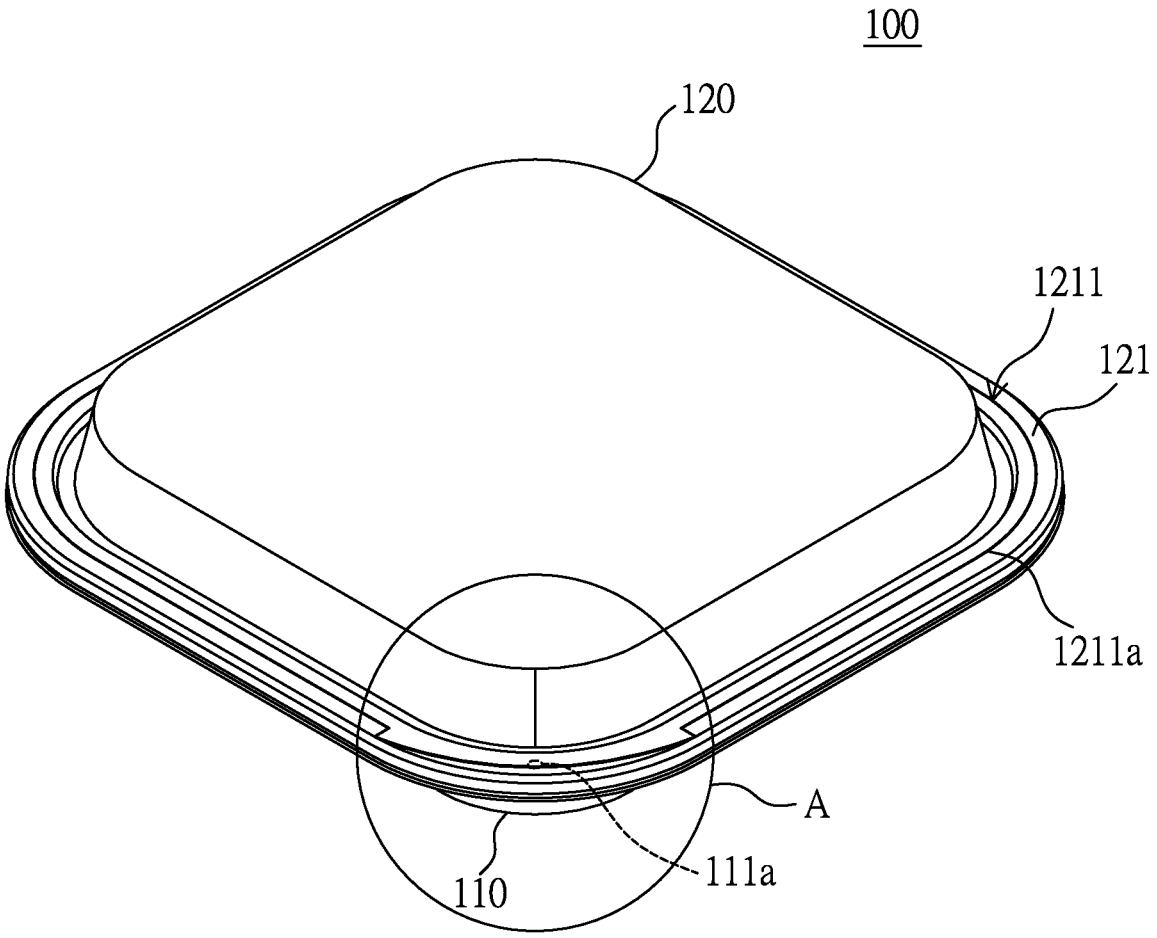
FIG. 2 illustrates an assembled diagram of the easy-tear-open and tamper-evident container shown in FIG. 1.
Figure 3:
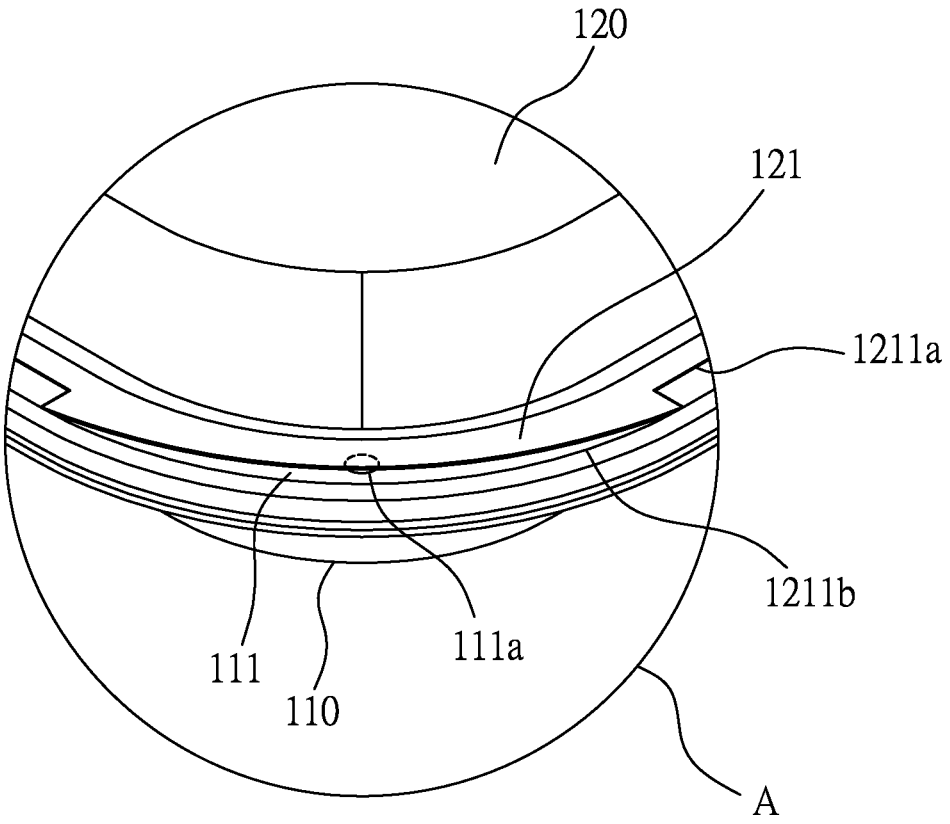
FIG. 3 is a partial enlarged schematic view of the easy-tear-open and tamper-evident container of FIG. 2.

Please refer to FIGS. 1 to 3, in which FIG. 1 illustrates an exploded diagram of one embodiment of the easy-tear-open and tamper-evident container of the present invention; FIG. 2 illustrates an assembled diagram of the easy-tear-open and tamper-evident container shown in FIG. 1; and FIG. 3 is a partial enlarged schematic view of the easy-tear-open and tamper-evident container of FIG. 2.

As shown in FIG. 1, a tamper-evident container 100 includes a container body 110 and a lid 120, where the container body 110 and the lid 120 can be made of plastic, and the container body 110 can be a transparent container.

The container body 110 has a first convex loop 111 on a periphery of an opening thereof, and the first convex loop 111 has a spacer part 111*a*; the lid 120 has a second convex loop 121 for engaging with the first convex loop 111, where a loop of tear line 1211 is provided on a topmost surface of the second convex loop 121, and the loop of tear line 1211 is divided into a section of breakable line 1211*a* and a section of broken line 1211*b*, the section of breakable line 1211*a* having a length larger than that of the broken line 1211*b*. The spacer part 111*a* is disposed below a local area of the topmost surface of the second convex loop 121 that bears the section of broken line 1211*b*.

When assembled, as shown in FIG. 2, the second convex loop 121 is engaged or sleeved with the first convex loop 111, and as the spacer part 111*a* is disposed below the local area of the topmost surface of the second convex loop 121 that bears the section of broken line, the local area is bent up to form an force application part to make it convenient for the legitimate user to open the tamper-evident container 100. In order to express the structure of the force application part more clearly, FIG. 3 depicts an enlarged schematic view of a partial area A of the tamper-evident container 100 of FIG. 2. It is apparent from FIG. 3 that the spacer part 111*a* bends the middle portion of the partial area upward.

When in the normal opening operation, the legitimate user can break the section of the breakable line 1211*a* by applying force to the force application part to remove a central area of the lid 120, so as to access the contents of the tamper-evident container 100. On the other hand, when an illegal person performs a lifting action in any area of the second convex loop 121 of the lid 120 corresponding to the section of breakable line 1211*a*, and the upward displacement of the any area exceeds a threshold value, a corresponding area of the section of breakable line 1211*a* will be broken to show that the tamper-evident container 100 has been tampered with. That is, as the second convex loop 121 is engaged or sleeved with the first convex loop 111, when an illegal person performs a lifting action in any area of the second convex loop 121 corresponding to the section of the breakable line 1211*a*, a stress will be transmitted to the section of the breakable line 1211*a* to cause a local fracture of the section of the breakable line 1211*a*. That is, the section of the breakable line 1211*a* will be broken only when it is subjected to a stress greater than a threshold value, and it may be a line pattern with intermittent cuts or intermittent half breaks, or a line pattern with the entire section being half broken.

In addition, after the legitimate user breaks the section of the breakable line 1211*a* of the lid 120 to remove the central area of the lid 120, the remaining edge of the lid 120 can still be attached to the first convex loop 111 of the container body 110, and the legitimate user can place the central area of the lid 120 back onto the first convex loop 111 to cover the container body 110 when needed.

In addition, although the container body 210 is quadrilateral in this embodiment, the invention is not limited thereto, the container body 210 can also be of other geometric shapes, such as circular, triangles and other polygons.

Figure 4:
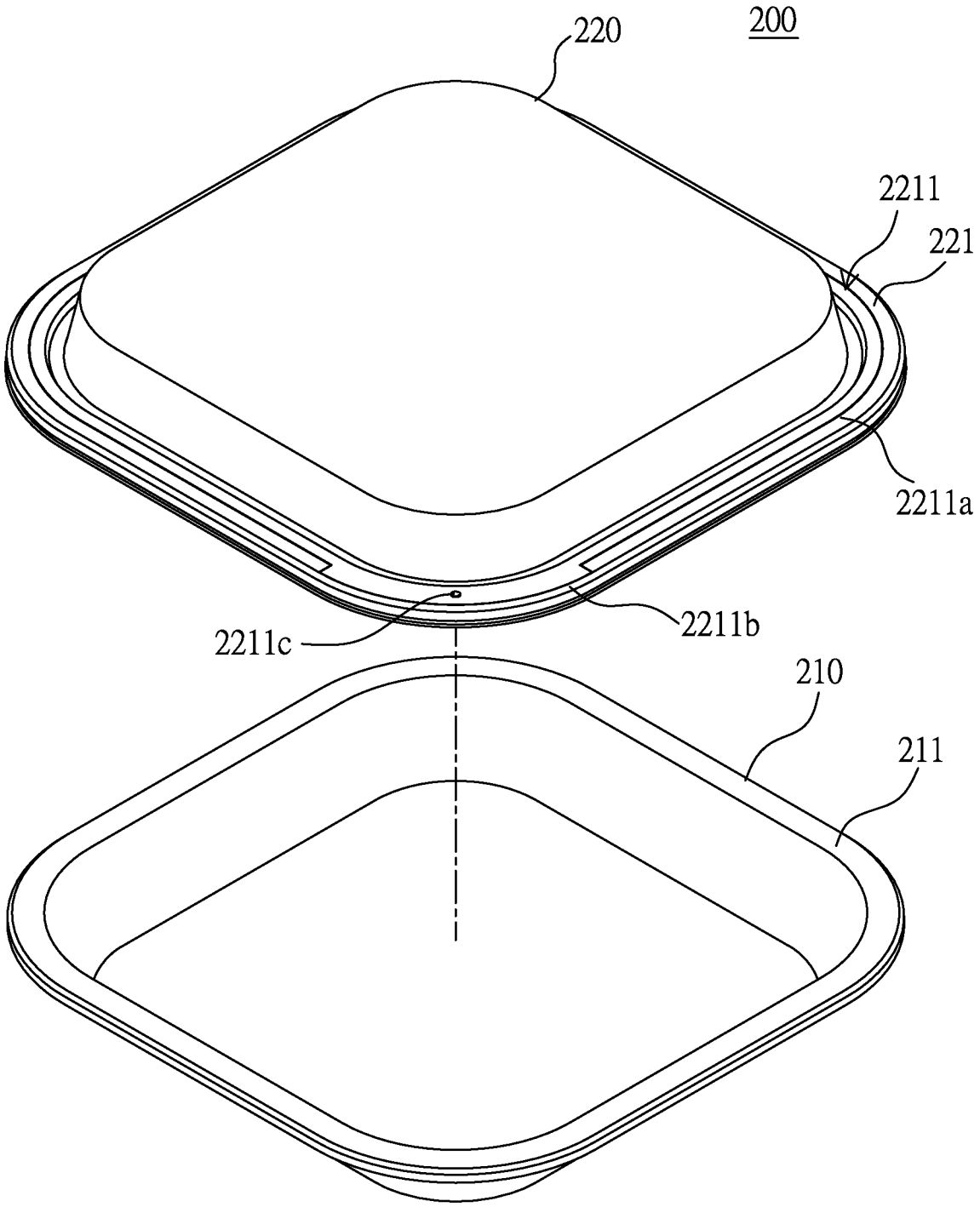
FIG. 4 illustrates an exploded diagram of another embodiment of the easy-tear-open and tamper-evident container of the present invention.
Figure 5:
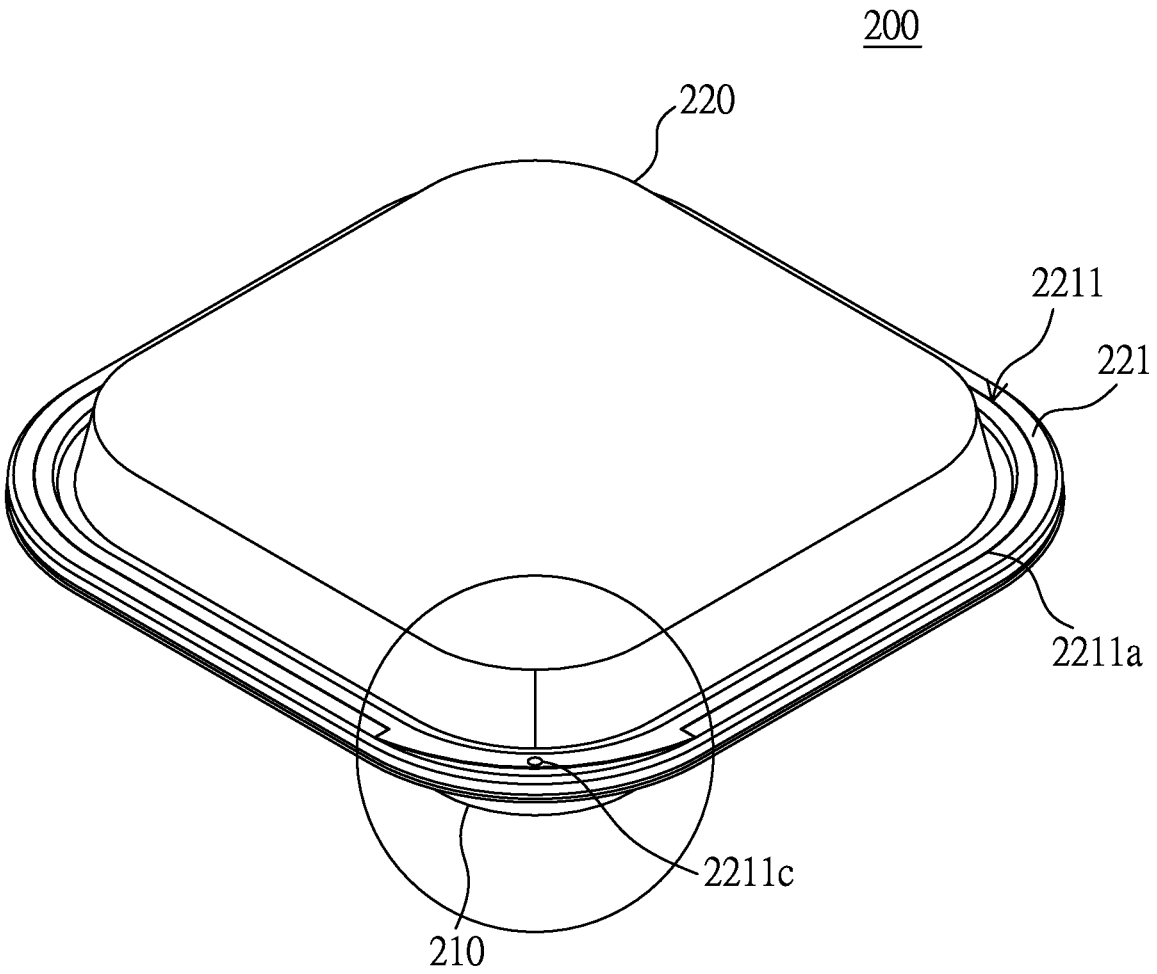
FIG. 5 illustrates an assembled diagram of the easy-tear-open and tamper-evident container shown in FIG. 4.
Figure 6:
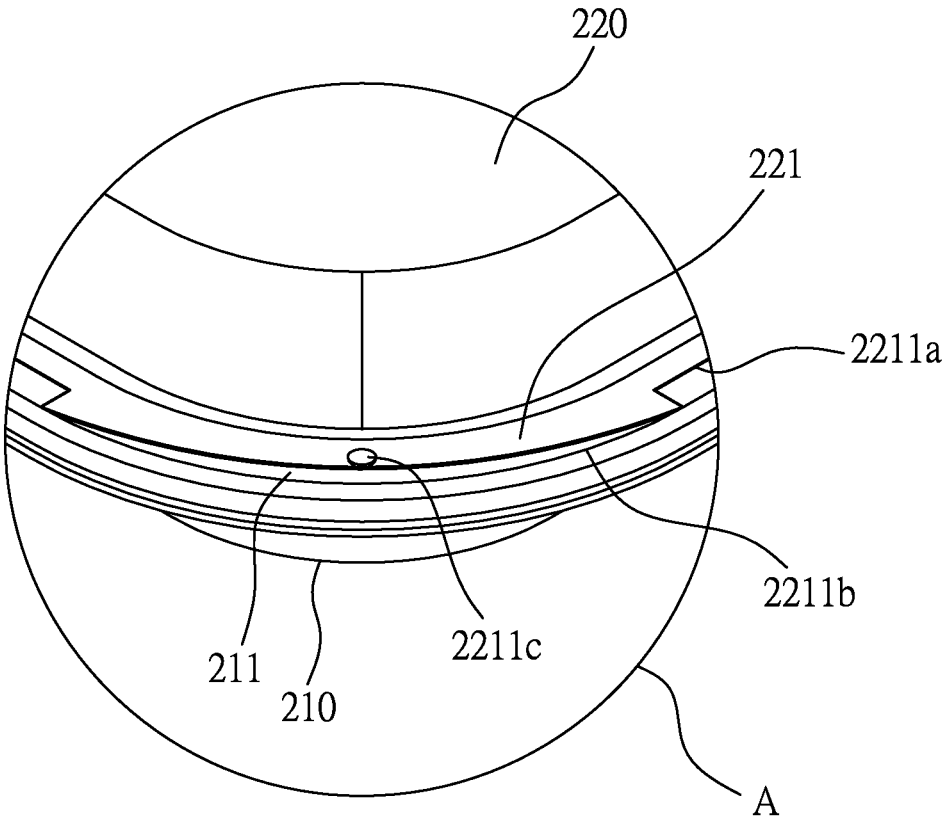
FIG. 6 is a partial enlarged schematic view of the easy-tear-open and tamper-evident container of FIG. 5.

In addition, the spacer part of the present invention can also be disposed on the lid. Please refer to FIGS. 4 to 6, in which, FIG. 4 illustrates an exploded diagram of another embodiment of the easy-tear-open and tamper-evident container of the present invention; FIG. 5 illustrates an assembled diagram of the easy-tear-open and tamper-evident container shown in FIG. 4; and FIG. 6 is a partial enlarged schematic view of the easy-tear-open and tamper-evident container of FIG. 5.

As shown in FIG. 4, a tamper-evident container 200 includes a container body 210 and a lid 220, where the container body 210 and the lid 220 can be made of plastic, and the container body 210 can be a transparent container.

The container body 210 has a first convex loop 211 on a periphery of an opening thereof; the lid 220 has a second convex loop 221 for engaging with the first convex loop 211, where a loop of tear line 2211 is provided on a topmost surface of the second convex loop 221, and the loop of tear line 2211 is divided into a section of breakable line 2211*a* and a section of broken line 2211*b*, where the section of breakable line 2211*a* has a length larger than that of the broken line 2211*b*, and a spacer part 2211*c* is disposed at a back surface of a local area of the topmost surface of the second convex loop 221 that bears the section of broken line 2211*b*.

When assembled, as shown in FIG. 5, the second convex loop 221 is engaged or sleeved with the first convex loop 211, and as the spacer part 2211*c* is disposed at the back surface the local area of the topmost surface of the second convex loop 221 that bears the section of broken line, the local area is bent up to form an force application part to make it convenient for the legitimate user to open the tamper-evident container 200. In order to express the structure of the force application part more clearly, FIG. 6 depicts an enlarged schematic view of a partial area A of the tamper-evident container 200 of FIG. 5. It is apparent from FIG. 6 that the spacer part 2211*c* bends the middle portion of the partial area upward.

Figure 7:
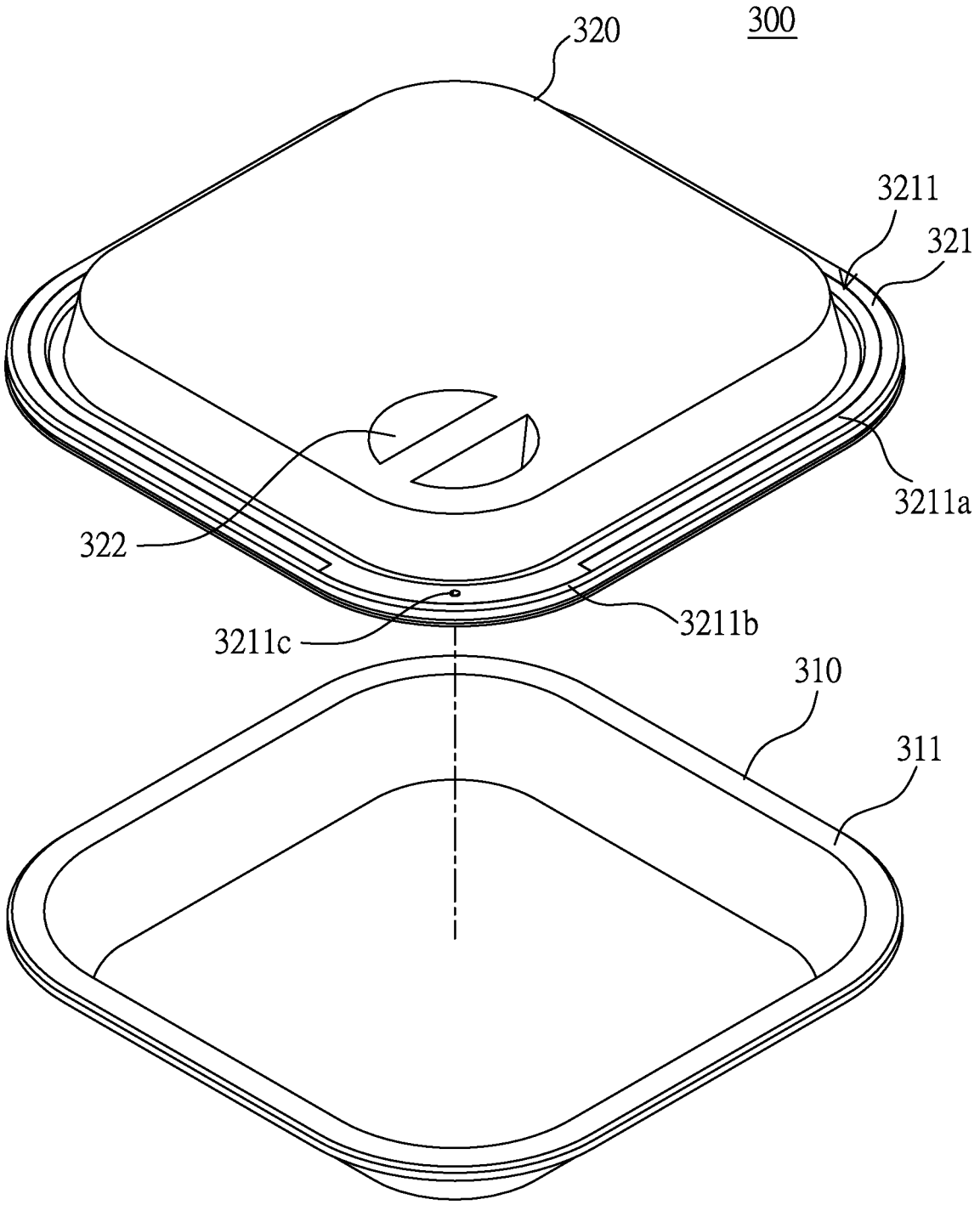
FIG. 7 illustrates an exploded diagram of another embodiment of the easy-tear-open and tamper-evident container of the present invention.

In addition, the easy-tear-open and tamper-evident container of the present invention can also provide a force application structure at the central area of the lid to make it convenient for the legitimate user to break the section of breakable line to open the lid to reach the contents thereof. Please refer to FIG. 7, which illustrates an exploded diagram of another embodiment of the easy-tear-open and tamper-evident container of the present invention. As shown in FIG. 7, a tamper-evident container 300 includes a container body 310 and a lid 320, where the container body 310 and the lid 320 can be made of plastic, and the container body 310 can be a transparent container.

The container body 310 has a first convex loop 311 on a periphery of an opening thereof; the lid 320 has a second convex loop 321 for engaging with the first convex loop 311, where a loop of tear line 3211 is provided on a topmost surface of the second convex loop 321, and the loop of tear line 3211 is divided into a section of breakable line 3211*a* and a section of broken line 3211*b*, where the section of breakable line 3211*a* has a length larger than that of the broken line 3211*b*, a spacer part 3211*c* is disposed at a back surface of a local area of the topmost surface of the second convex loop 321 that bears the section of broken line 3211*b*, and the lid 320 has a force application structure 322 formed inside an area surrounded by the second convex loop 321, where the force application structure 322 has multiple concave or convex structures. With this design, the legitimate user can apply force through the local up-bent edge of the second convex loop 321 caused by the spacer part 3211*c* to completely break the section of the breakable line 3211*a* of the lid 320, and thereby remove a central area of the lid 320; or break the section of the breakable line 3211*a* by pulling up or pressing the plurality of concave or convex structures of the force application structure 322 to remove a central area of the lid 320, so as to access the contents of the tamper-evident container 300.

Figure 8:
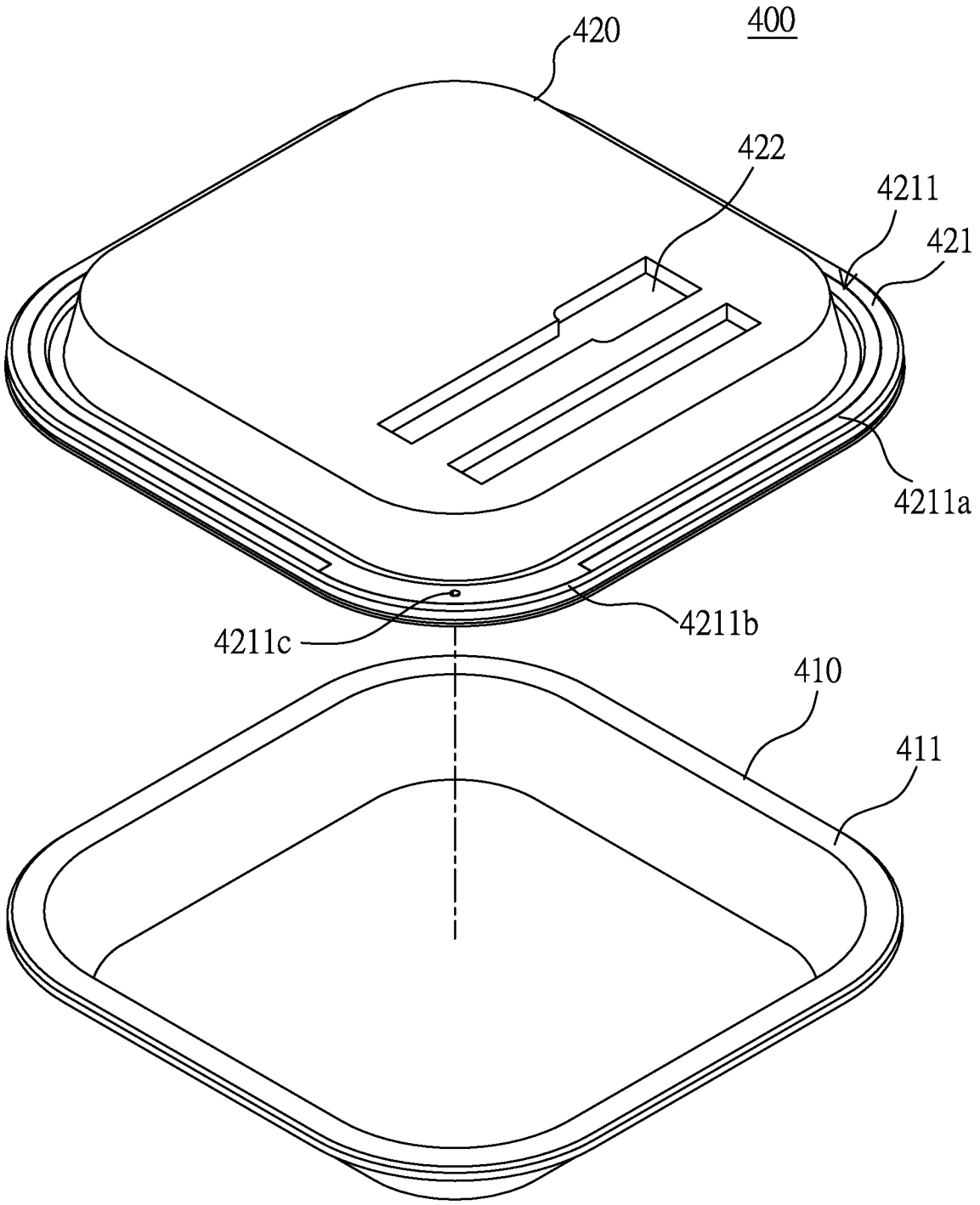
FIG. 8 illustrates an exploded diagram of still another embodiment of the easy-tear-open and tamper-evident container of the present invention.

In addition, the lid of the easy-tear-open and tamper-evident container of the present invention may have a tableware accommodating structure formed inside the area surrounded by the second convex loop for accommodating at least one piece of tableware. Please refer to FIG. 8, which illustrates an exploded diagram of still another embodiment of the easy-tear-open and tamper-evident container of the present invention. As shown in FIG. 8, a tamper-evident container 400 includes a container body 410 and a lid 420, where the container body 410 and the lid 420 can be made of plastic, and the container body 410 can be a transparent container.

The container body 410 has a first convex loop 411 on a periphery of an opening thereof; the lid 420 has a second convex loop 421 for engaging with the first convex loop 411, where a loop of tear line 4211 is provided on a topmost surface of the second convex loop 421, and the loop of tear line 4211 is divided into a section of breakable line 4211*a* and a section of broken line 4211*b*, where the section of breakable line 4211*a* has a length larger than that of the broken line 4211*b*, a spacer part 4211*c* is disposed at a back surface of a local area of the topmost surface of the second convex loop 421 that bears the section of broken line 4211*b*, and the lid 420 has a tableware accommodating structure 422 formed inside the area surrounded by the second convex loop 421 for accommodating at least one piece of tableware, where the tableware can be chopsticks, spoons, knives or forks.

In addition, in the description of the embodiments mentioned above, although the lid (120, 220, 320, 420) is separated from the container body (110, 210, 310, 410), the invention is not limited thereto. The lid (120, 220, 320, 420) and the container body (110, 210, 310, 410) can also be partially connected.

In addition, in the description of the embodiments mentioned above, although the arc part of the section of broken line (1211*b*, 2211*b*, 3211*b*, 4211*b*) is disposed out of the extended track of the section of breakable line (1211*a*, 2211*a*, 3211*a*, 4211*a*), the invention is not limited thereto. The broken line (1211*b*, 2211*b*, 3211*b*, 4211*b*) can also be set on the extended track of the section of breakable line (1211*a*, 2211*a*, 3211*a*, 4211*a*).

In addition, in the description of the embodiments mentioned above, although only a loop of tear line (1211, 2211, 3211, 4211) is disclosed, the invention is not limited thereto. The topmost surface of the second convex loop can also have multiple loops of tear line.

Thanks to the designs disclosed above, the easy-tear-open and tamper-evident container of the invention can provide the following advantages:

1. The easy-tear-open and tamper-evident container of the invention, by installing a loop of tear line around the periphery of the lid of the container, can leave evidence at any part of the periphery of the container when that part of the periphery is opened by an illegitimate person.

2. The easy-tear-open and tamper-evident container of the invention has an up-bent force application part formed at a local area of a convex loop of the lid for the legitimate user to easily apply a force thereon to break the loop of tear line to open the lid.

3. The easy-tear-open and tamper-evident container of the invention can enable the user to place the removed central part of the lid back onto the convex loop of the container to preserve warmth or prevent pollution.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance over the conventional structure and further complies with the patent application requirements and is submitted to the Patent and Trademark Office for review and granting of the commensurate patent rights.

What is claimed is:

1. An easy-tear-open and tamper-evident container comprising:

a container body having a first convex loop located on a periphery of an opening thereof, the first convex loop being a raised arcuate portion having an opening of an arc facing a bottom of the container body and an apex of the arc being raised towards a top of the container body;

a lid having a second convex loop located on a periphery thereof for engaging with the first convex loop, the second convex loop being a raised arcuate portion having an opening of an arc facing a bottom of the lid and an apex of the arc being raised towards a top of the lid, where a loop of tear line is provided on a topmost surface of the second convex loop, and the loop of tear line is divided into a section of breakable line and a section of broken line, the section of breakable line having a length larger than that of the broken line; and a spacer part being disposed below a local area of the topmost surface of the second convex loop that bears the section of broken line, the local area being a part of the second convex loop and the lid and located along a rim of the lid, and the spacer part being attached with the lid or the container body to make the local area bent up to form a force application part;

where, when in a normal opening operation, the force application part is used for a user to apply a force thereon to break the section of breakable line to remove a central area of the lid; and when an illegitimate user applies a lifting force to any local area of the second convex loop of the lid that has the section of breakable line of the second convex loop to make the local area move upward with a displacement exceeding a threshold, a corresponding local area of the section of breakable line of the second convex loop will be broken to show that the tamper-evident container has been tampered with;

wherein the lid has a force application structure formed inside an area surrounded by the second convex loop, and the force application structure has multiple arcuate recesses formed in the top of the lid for a legitimate user to pull up or press down to break the section of breakable line.

2. The easy-tear-open and tamper-evident container as disclosed in claim 1, wherein the lid is made of plastic.

3. The easy-tear-open and tamper-evident container as disclosed in claim 1, wherein the container body is made of plastic.

4. The easy-tear-open and tamper-evident container as disclosed in claim 1, wherein the container body is transparent.

5. The easy-tear-open and tamper-evident container as disclosed in claim 1, wherein the container body has a shape of circle or polygon.

6. The easy-tear-open and tamper-evident container as disclosed in claim 1, wherein the lid has a tableware accommodating structure formed inside the area surrounded by the second convex loop for accommodating at least one piece of tableware.

7. The easy-tear-open and tamper-evident container as disclosed in claim 6, wherein the at least one piece of tableware is selected from a group consisting of chopsticks, spoons, knives, forks and any combination thereof.

* * * * *